US007442086B1

(12) United States Patent
Chang

(10) Patent No.: US 7,442,086 B1
(45) Date of Patent: Oct. 28, 2008

(54) CHIP CARD RETAINING MECHANISM

(75) Inventor: Ming-Shiung Chang, Tu-Cheng (TW)

(73) Assignee: Chi Mei Communication Systems, Inc., Tu-Cheng, Taipei County (TW)

( * ) Notice: Subject to any disclaimer, the term of this patent is extended or adjusted under 35 U.S.C. 154(b) by 0 days.

(21) Appl. No.: 11/964,870

(22) Filed: Dec. 27, 2007

(30) Foreign Application Priority Data

Nov. 2, 2007 (CN) ..... 2007 1 0202369

(51) Int. Cl.
*H01R 24/00* (2006.01)

(52) U.S. Cl. ..... 439/630; 439/40; 439/305

(58) Field of Classification Search ..... 439/39–40, 439/305, 630, 632
See application file for complete search history.

(56) References Cited

U.S. PATENT DOCUMENTS 6,261,128 B1 * 7/2001 Heim et al. ..... 439/630
6,814,597 B1 * 11/2004 Kao ..... 439/159
7,044,799 B1 * 5/2006 Lai ..... 439/630
7,112,075 B1 * 9/2006 Su ..... 439/159

* cited by examiner

*Primary Examiner*—Truc T Nguyen

(57) ABSTRACT

A chip card retaining mechanism for a portable electronic device (100) is provided. The chip card retaining mechanism is used for retaining a card (10). The portable electronic device includes a main body (40) and a cover body (80). The cover body is attached with the main body so as to define a receiving space therewithin. The chip card retaining mechanism includes a mounting base (50), a sliding tray (60) for carrying the card, a latching assembly (70). The sliding tray has a first magnetic member (66) and a second magnetic member (68) mounted in a same side of the sliding tray. The latching assembly includes a latching block (74) having a third magnetic member (79) disposed thereon. The latching block is configured for sliding relative to the sliding tray. The third magnetic member selectively acts on the first magnetic member and the second magnetic member.

19 Claims, 4 Drawing Sheets

CHIP CARD RETAINING MECHANISM

BACKGROUND OF THE INVENTION

1. Field of the Invention

The present invention relates to chip card retaining mechanisms, particularly to a chip card retaining mechanism for seating a chip card in a portable electronic device.

2. Description of Related Art

Nowadays, portable electronic devices such as mobile phones or media players are widely used and bring convenience to our lives, and as such, electronic devices have become a part of modern life. Every electronic device has a chip card such as a SIM (subscriber identification module) card for carrying information necessary for operating the mobile phone.

It is essential to provide a chip card retaining mechanism to hold the chip card in the electronic device. The chip card retaining mechanism typically retains the chip card therewith. However, the retained chip card requires to be manually removed by users from the chip card retaining mechanism.

Moreover, as the typical chip card retaining mechanism inadvertently undergoes impact, this impact may result in an outer force which can, at a minimum, result in an ineffective electrical connection between the chip card and a chip card connector originally electrically connecting with the card. At worst, the chip card may detach from the chip card retaining mechanism.

Therefore, a heretofore-unaddressed need exists in the art to address the aforementioned deficiencies and inadequacies.

SUMMARY

In present aspect, a chip card retaining mechanism for a portable electronic device is provided. The chip card retaining mechanism is used for retaining a chip card. The portable electronic device includes a main body and a cover body. The cover body is attached with the main body so as to define a receiving space therewithin. The chip card retaining mechanism includes a mounting base, a sliding tray configured for carrying the chip card, a latching assembly mounted on the mounting base. The sliding tray has a first magnetic member and a second magnetic member mounted in a same side of the sliding tray. The latching assembly includes a latching block having a third magnetic member disposed thereon. The latching block is configured for sliding relative to the sliding tray in such a manner that the third magnetic member selectively acts on the first magnetic member and the second magnetic member.

In another aspect, a portable electronic device using the present chip card retaining mechanism is provided. The portable electronic device includes a main body and a cover body. The cover body is attached with the main body so as to define a receiving space therewithin. The mounting base, the sliding tray, and the latching assembly are received in the receiving space.

These and other aspects of the present invention will become more apparent from the following detailed description of the preferred embodiments taken in conjunction with the accompanying drawings, although variations and modifications therein may be affected without departing from the spirit and scope of the novel concepts of the disclosure.

BRIEF DESCRIPTION OF THE DRAWINGS

Many aspects of the present chip card retaining mechanism can be better understood with reference to the following drawings. These drawings are not necessarily drawn to scale, the emphasis instead being placed upon clearly illustrating the principles of the present chip card retaining mechanism. Moreover, in the drawings like reference numerals designate corresponding parts throughout the several views. Wherever possible, the same reference numbers are used throughout the drawings to refer to the same or like elements of an embodiment.

DETAILED DESCRIPTION OF THE EMBODIMENTS

The present chip card retaining mechanism for retaining a card (e.g., chip card or storage card) is described here in conjunction with the accompanying drawings in FIGS. 1 through 5. The chip card retaining mechanism is suitably assembled in a portable electronic device, such as a MP3 player, a mobile phone, a personal digital handset, or the like.

Referring to FIGS. 1 through 4, the MP3 player 100 is exemplified to illustrate the chip card retaining mechanism (not labeled) assembled therewith. The chip card retaining mechanism is used for retaining a storage chip card 10 within the MP3 player 100.

Figure 1:
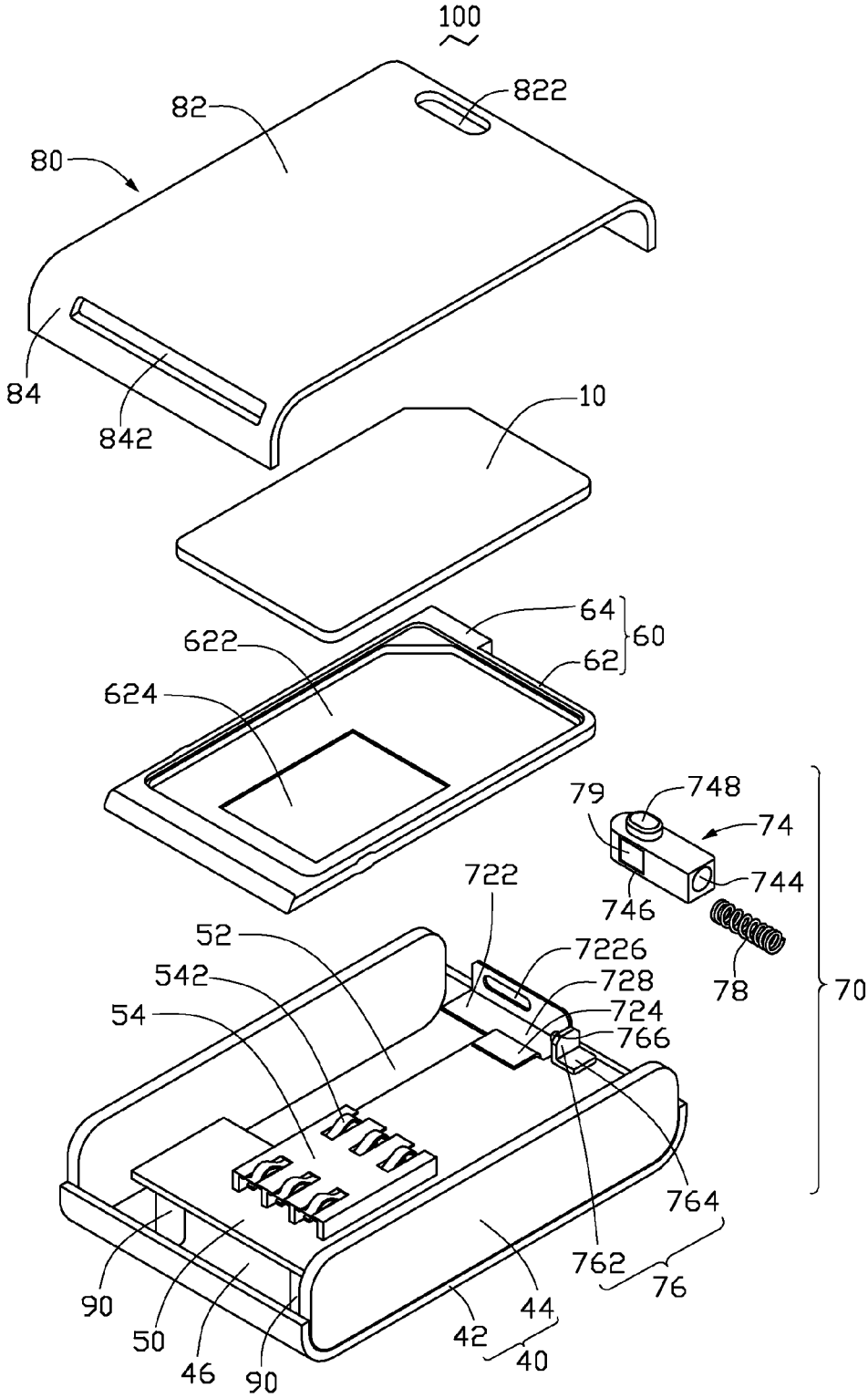
FIG. 1 is an isometric and exploded view of a chip card retaining mechanism secured within a portable electronic device in accordance with a present embodiment.
Figure 2:
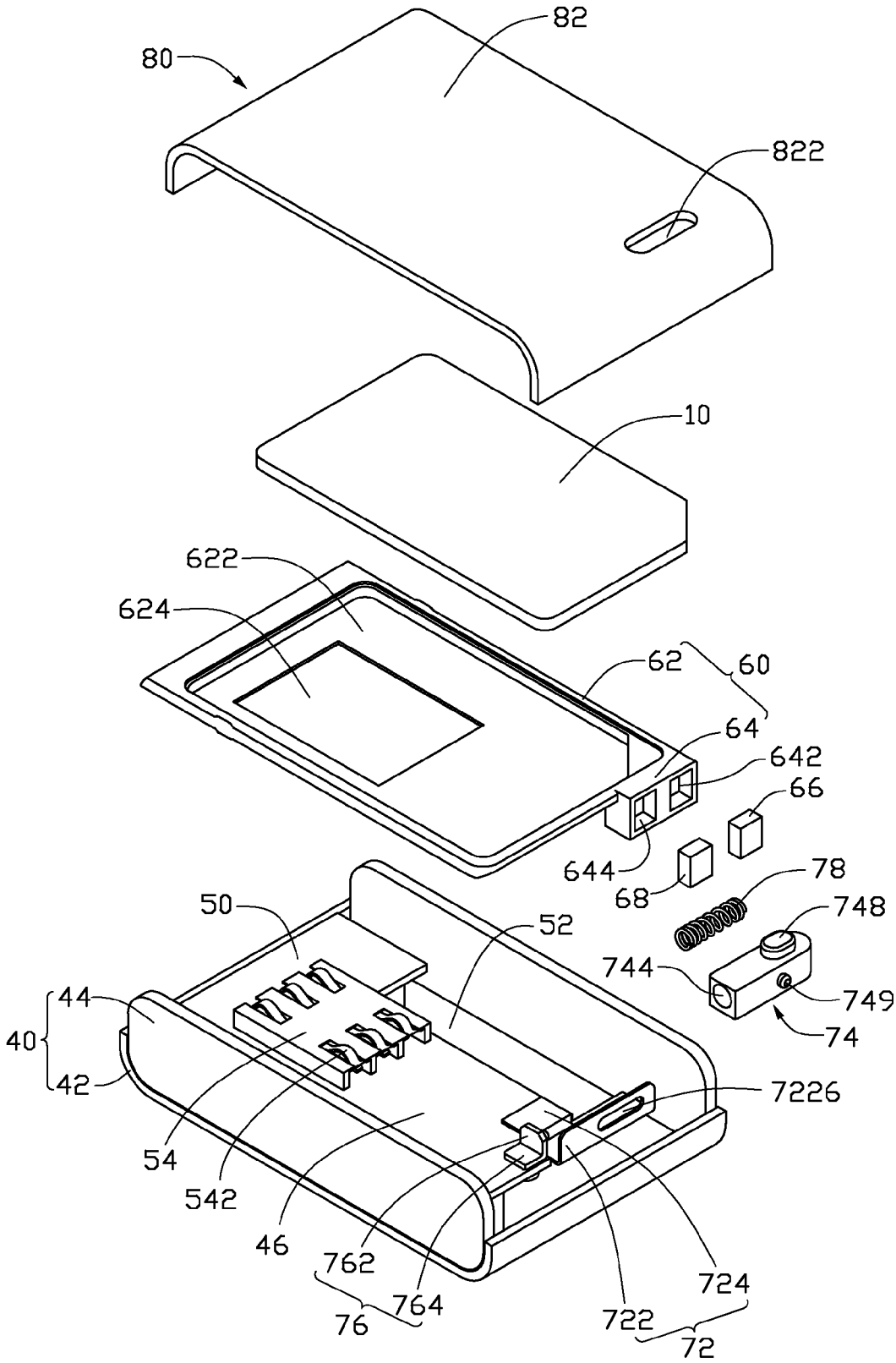
FIG. 2 is another exploded view of the chip card retaining mechanism combined with the portable electronic device shown in FIG. 1, showing another aspect thereof.

Referring to FIGS. 1 and 2 for detail, the MP3 player 100 includes a main body 40 and a cover body 80. The main body 40 includes a lower board 42 and two opposite sideboards 44 which together form a receiving space 46 therebetween. The cover body 80 is configured (e.g., structured/arranged) to attach with the main body 40 so as to define a receiving space (not labeled) therewithin. The cover body 80 is generally a rectangular board and includes an upper wall 82 and two bent walls 84 opposite to each other. The upper wall 82 defines a first through slot 822 therethrough. One of the two opposite bent walls 84 has a second through slot 842 defined therethrough.

The chip card retaining mechanism includes a mounting base 50 mounted on the main body 40, a sliding tray 60 configured for carrying the storage chip card 10, and a latching assembly 70 mounted on the mounting base 50. The mounting base 50, the sliding tray 60, and the latching assembly 70 are received in the receiving space 46.

The mounting base 50 has four columns 90 extending from one bottom side thereof. The four columns 90 are configured for attaching the mounting base 50 with the main body 40. The mounting base 50 is advantageously a printed circuit board. The mounting base 50 has a card connector 54 disposed thereon for electrically connecting with the storage chip card 10. The mounting base 50, one sideboard 44 of the main body 40, and the lower board 42 of the main body 40 cooperatively enclose a general rectangular sliding groove 52 therebetween.

The sliding tray 60 is generally rectangular and includes a base portion 62 and a sliding protrusion 64 formed on a corner side of the base portion 62. The base portion 62 corresponds with the second through slot 842 of the cover body 80 and is configured for sliding along the mounting base 50 through the second through slot 842 of the cover body 80. The base portion 62 defines a card groove 622 therein and an opening 624 therethrough. The opening 624 communicates with the card groove 622. The card groove 622 is configured for accommodating the storage chip card 10 therein. The opening 624 allows the card connector 54 to expose therethrough when the sliding tray 60 is fully pushed into the receiving space 46.

The sliding protrusion 64 is generally rectangular and configured for sliding along the sliding groove 52 of the MP3 player 100. The sliding protrusion 64 defines two rectangular mounting recesses 642 and 644 in a same side of the sliding protrusion 64. The two mounting recesses 642 and 644 respectively have the first magnetic member 66 and the second magnetic member 68 mounted therein with one respective magnetic pole exposed therefrom. The exposed magnetic pole of the first magnetic member 66 has an adverse magnetic property with that of the second magnetic member 68. The exposed magnetic pole of the first magnetic member 66 is advantageously magnetic south pole. The exposed magnetic pole of the second magnetic member 68 is advantageously magnetic north pole.

The latching assembly 70 includes a latching block 74 having a third magnetic member 79 disposed thereon. The latching block 74 is configured for sliding relative to the sliding tray 60 in such a manner that the third magnetic member 79 selectively acts on the first magnetic member 66 and the second magnetic member 68, so that the sliding tray 60 slides along the mounting base 50 or is retained in the receiving space 46.

The latching assembly 70 further includes a guiding rail 72, a limiting member 76, and an elastic member 78. The limiting member 76 is configured for limiting the sliding of the latching block 74 along the guiding rail 72. The elastic member 78 is configured for restoring the latching block 74 to be at a predetermined position.

The latching block 74 is generally rectangular and includes a mounting recess 746, an accommodating aperture 744, an operating portion 748, and a guiding post 749. The mounting recess 746 and the accommodating aperture 744 are respectively defined in two adjacent sidewalls of the latching block 74. The third magnetic member 79 is mounted into the mounting recess 746 with one respective magnetic pole exposed therefrom. The exposed magnetic pole of the third magnetic member 79 is advantageously magnetic north pole. The accommodating aperture 744 is configured for accommodating the elastic member 78 therein.

The operating portion 748 is formed on an upper wall of the latching block 74. The operating portion 748 is configured to expose through the first through slot 822 of the cover body 80. Users may pull/push the operating portion 748 and, thus the latching block 74 slides relative to the sliding tray 60 along the guiding rail 72. The guiding post 749 is formed on another sidewall of the latching block 74 and located opposite to the mounting recess 746 of the latching block 74.

The guiding rail 72 is advantageously a bent sheet including a main sheet 722 and an extending sheet 724. The extending sheet 724 is generally L-shaped, which extends from the main sheet 722 and has one side thereof mounted on the mounting base 50. The main sheet 722 is generally L-shaped and has a guiding groove 7226 defined therethrough corresponding with the guiding post 749 of the latching block 74. The guiding groove 7226 is defined through one side of the main sheet 722 and located opposite to the extending sheet 724. The guiding groove 7226 is configured for facilitating the guiding post 749 engaging into the guiding groove 7226 and sliding therealong. The extending sheet 724 connects with the main sheet 722, both of which cooperatively define a latching groove 728 facilitating the latching block 74 of the latching assembly 70 sliding along the latching groove 728.

The limiting member 76 is advantageously a L-shaped bent sheet and has a mounting sheet 764 thereof mounted on the mounting base 50. The mounting sheet 764 is aligned with the latching groove 728 of the guiding rail 72. The limiting member 76 has a mounting protrusion 766 disposed on a limiting sheet 762 thereof, and the mounting protrusion 766 is protruded from the limiting sheet 762 towards the latching groove 728.

The elastic member 78 is advantageously a coil spring. The elastic member 78 has one end thereof exposed and disposed around the mounting protrusion 766 and resisting against the limiting sheet 762. The elastic member 78 has the other end thereof resisting against the latching block 74 and accommodated in the accommodating aperture 744 of the latching block 74.

Figure 3:
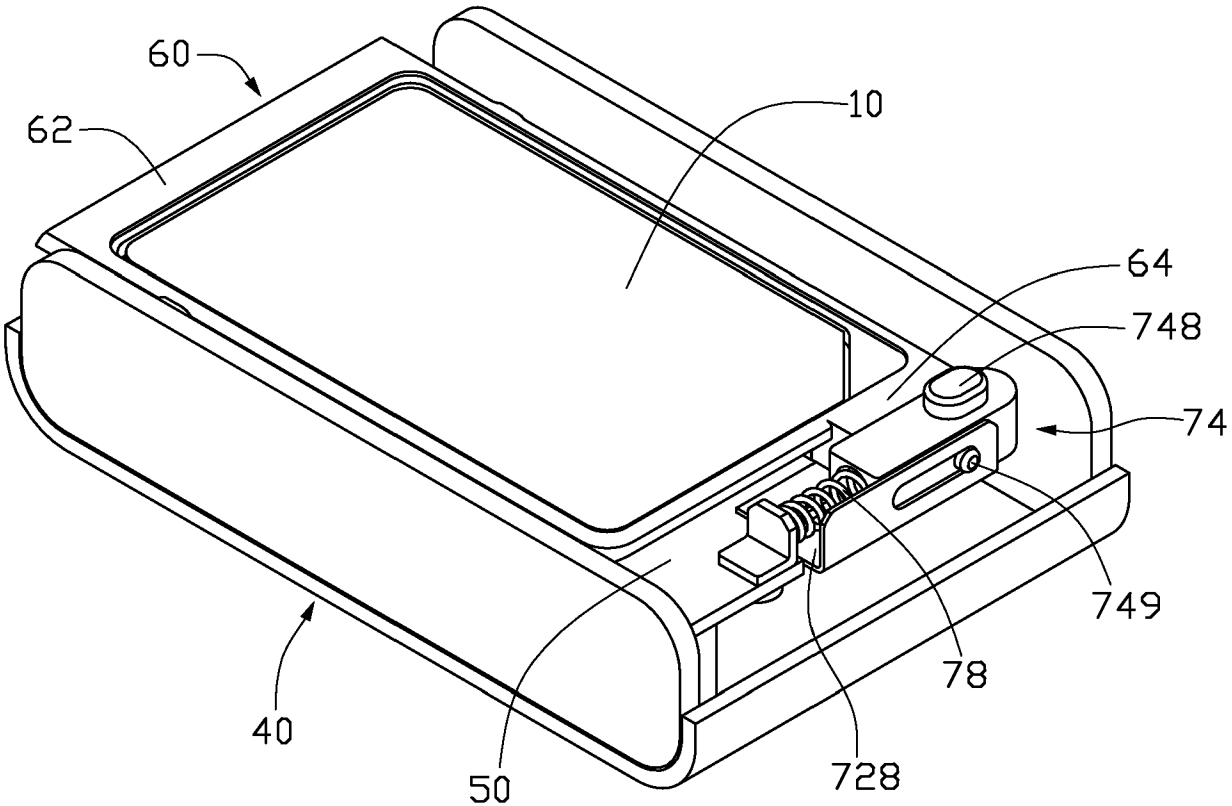
FIG. 3 is an assembled view of the chip card retaining mechanism and the portable electronic device illustrated in FIG. 1, wherein a cover body of the portable electronic device is removed for illustrative purpose.

In assembly, referring further to FIG. 3, the elastic member 78 is placed into the accommodating aperture 744 of the latching block 74. The latching block 74 combined with the elastic member 78 engages into the latching groove 728 of the guiding rail 72 by engaging the guiding post 749 of the latching block 74 into the guiding groove 7226 of the guiding rail 72. In this case, the elastic member 78 has one end thereof exposed and disposed around the mounting protrusion 766 of the limiting member 76 and resisting against the limiting sheet 762 of the limiting member 76 and the other end thereof resisting against the latching block 74.

After that, the sliding protrusion 64 of the sliding tray 60 is placed into the sliding groove 52 of the main body 40 with the mounted first magnetic member 66 and the mounted second magnetic member 68 proximate to the guiding rail 72. The mounted first magnetic member 66 is further attached with the mounted third magnetic member 79 of the latching block 74 by a magnetic force generated therebetween. The cover body 80 is then attached (e.g., welded) with the main body 40. In this case, the base portion 62 of the sliding tray 60 and the operating portion 748 of the latching block 74 are aligned with the second through slot 842 and the first through slot 822 of the cover body 80, respectively. The operating portion 748 further exposes through the first through slot 822. The assembly process of the chip card retaining mechanism is finished.

Figure 4:
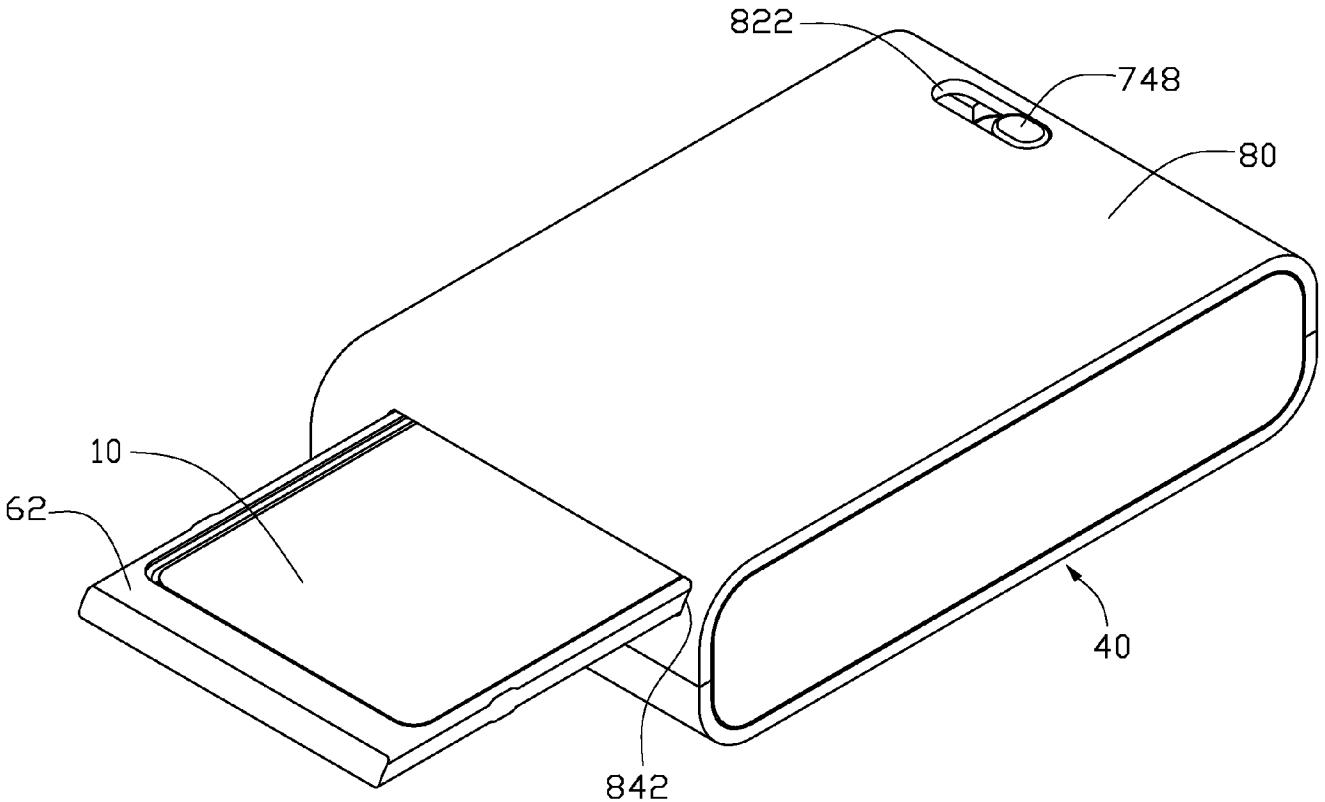
FIG. 4 is an assembled view of the chip card retaining mechanism and the portable electronic device illustrated in FIG. 1, as a sliding tray of the chip card retaining mechanism is transformed from a close state to an open state.

In use, referring further to FIG. 4, the sliding tray 60 is transformed from a close state to an open state. The close state of the sliding tray 60 indicates that the sliding tray 60 is secured within the receiving space of the MP3 player 100. As such, the first magnetic member 66 of the sliding tray 60 is attached with the third magnetic member 79 of the latching block 74. The open state of the sliding tray 60 indicates that the base portion 62 of the sliding tray 60 can slide along the sliding groove 52 of the main body 40 through the second through slot 842 of the cover body 80.

In the transforming process, the operating portion 748 is pushed along the first through slot 822 of the cover body 80 towards the limiting sheet 762 of the latching assembly 70. The first magnetic member 66 is thus detached from the third magnetic member 79, which enables the sliding tray 60 to be detached from the latching block 74. At this stage, a magnetic force generated by the mounted second magnetic member 68 of the sliding tray 60 and the third magnetic member 79, drives the sliding tray 60 to slide along the sliding groove 52 through the second through slot 842. The sliding tray 60 at the open state is extracted from the cover body 80 so as to carry the storage chip card 10 within the card groove 622 of the base portion 62.

As the operating portion 748 is released, the elastic member 78 restores and enables the latching block's 74 sliding back to the predetermined position. The sliding tray 60 carrying the storage chip card 10 therewith is pressed back into the receiving space of the MP3 player 100. The sliding tray 60 is attached with the latching block 74 again by the magnetic attachment of the first magnetic member 66 and the second magnetic member 68. At this time, the storage chip card 10 electrically connects with the card connector 54 exposed through the opening 624 of the base portion 62.

One main advantage of the present embodiment embodies that the sliding tray 60 for carrying the storage chip card 10 can be firmly attached with or freely detached from the latching block 74 by magnetic forces. The retaining process of the storage chip card 10 can be conveniently achieved by simply pressing the sliding tray 60 carrying the storage chip card 10 into the receiving space of the main body 40. The extracting process of the storage chip card 10 can be conveniently achieved by simply pushing the operating portion 748 of the latching block 74.

It is to be understood, however, that even through numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A chip card retaining mechanism for retaining a chip card in a portable electronic device which includes a main body attached to a cover body thereby defining a receiving space therewithin, the chip card retaining mechanism comprising:

a mounting base;

a sliding tray configured for carrying the chip card, the sliding tray having a first magnetic member and a second magnetic member mounted in a same side of the sliding tray; and a latching assembly mounted on the mounting base, the latching assembly comprising a latching block having a third magnetic member disposed thereon;

wherein the mounting base, the sliding tray, and the latching assembly are received in the receiving space, the latching block being configured for sliding relative to the sliding tray in such a manner that the third magnetic member selectively acts on the first magnetic member and the second magnetic member.

2. The chip card retaining mechanism as claimed in claim 1, wherein the latching assembly further comprises a guiding rail, a limiting member, and an elastic member, the limiting member being configured for limiting the latching block to slide along the guiding rail, and the elastic member being configured for restoring the latching block to be at a predetermined position.

3. The chip card retaining mechanism as claimed in claim 2, wherein the latching block slides relative to the sliding tray as the latching block slides along the guiding rail.

4. The chip card retaining mechanism as claimed in claim 2, wherein the guiding rail comprises a main sheet and an extending sheet, the extending sheet being mounted on the mounting base, the extending sheet and the main sheet cooperatively defining a latching groove, and the latching block sliding along the latching groove.

5. The chip card retaining mechanism as claimed in claim 4, wherein the main sheet defines a guiding groove, the latching block forms a guiding post, the guiding post is engaged into the guiding groove and is configured for sliding along the guiding groove.

6. The chip card retaining mechanism as claimed in claim 2, wherein the latching block comprises a mounting recess, the third magnetic member being mounted into the mounting recess.

7. The chip card retaining mechanism as claimed in claim 2, wherein the latching block defines an accommodating aperture, the limiting member having a mounting protrusion formed thereon, and the elastic member being accommodated in the accommodating aperture with one end exposed and disposed around the mounting protrusion.

8. The chip card retaining mechanism as claimed in claim 7, wherein the limiting member comprises a limiting sheet and a mounting sheet, the mounting sheet being mounted on the mounting base, the mounting protrusion being disposed on the limiting sheet, and the limiting sheet being configured for resisting against the elastic member.

9. The chip card retaining mechanism as claimed in claim 2, wherein the latching block comprises an operating portion, the operating portion being configured to be operated to slide the latching block relative to the sliding tray.

10. The chip card retaining mechanism as claimed in claim 1, wherein the sliding tray comprises a base portion, the base portion defining a card groove and an opening, the mounting base has a card connector disposed thereon, and the card connector is configured for exposing through the opening.

11. The chip card retaining mechanism as claimed in claim 10, wherein the sliding tray further comprises a sliding protrusion, the sliding protrusion is formed on the base portion, the sliding protrusion defines two mounting recesses, the two mounting recesses respectively having the first magnetic member and the second magnetic member mounted therein with one respective magnetic pole exposed therefrom, and the exposed magnetic pole of the first magnetic member has an adverse magnetic property with that of the second magnetic member.

12. The chip card retaining mechanism as claimed in claim 1, wherein the mounting base defines a sliding groove, and the sliding protrusion and configured for sliding along the sliding groove.

13. The chip card retaining mechanism as claimed in claim 1, wherein the sliding tray has the first magnetic member and the second magnetic member mounted therein with one respective magnetic pole exposed therefrom, and the exposed magnetic pole of the first magnetic member has an adverse magnetic property to that of the second magnetic member.

14. A portable electronic device, comprising:

a main body;

a cover body attached with the main body so as to define a receiving space therewithin;

a chip card retaining mechanism configured for retaining a chip card, comprising:

a mounting base mounted on the main body;

a sliding tray configured for carrying the chip card, the sliding tray having a first magnetic member and a second magnetic member mounted in a same side of the sliding tray; and a latching assembly mounted on the mounting base, comprising a latching block having a third magnetic member disposed thereon;

wherein the mounting base, the sliding tray, and the latching assembly are received in the receiving space, the latching block being configured for sliding relative to the sliding tray in such a manner that the third magnetic member selectively acts on the first magnetic member and the second magnetic member.

15. The portable electronic device as claimed in claim 14, wherein the latching assembly further comprises a guiding rail, a limiting member, and an elastic member, the limiting member being configured for limiting the latching block sliding along the guiding rail, and the elastic member being configured for restoring the latching block to be at a predetermined position.

16. The portable electronic device as claimed in claim 14, wherein the cover body comprises a first through slot, the latching block comprises an operating portion, the operating portion being configured to be operated to slide the latching block relative to the sliding tray, and the operating portion exposed through the first through slot.

17. The portable electronic device as claimed in claim 16, wherein the cover body further comprises a second through slot, the sliding tray comprises a base portion, and the base portion of the sliding tray being configured for sliding along the mounting base through the second through slot of the cover body.

18. The portable electronic device as claimed in claim 14, wherein the mounting base comprises four columns, the four columns being configured for attaching the mounting base with the base body.

19. The portable electronic device as claimed in claim 14, wherein the sliding tray having the first magnetic member and the second magnetic member mounted therein with one respective magnetic pole exposed therefrom, and the exposed magnetic pole of the first magnetic member having an adverse magnetic property with that of the second magnetic member.

* * * * *